United States Patent [19]

Anderson

[11] 4,083,410

[45] Apr. 11, 1978

[54] ADJUSTABLE DROP NIPPLE FOR SPRINKLER HEADS

[75] Inventor: James R. Anderson, Berwyn, Pa.

[73] Assignee: Central Sprinkler Corporation, Lansdale, Pa.

[21] Appl. No.: 716,066

[22] Filed: Aug. 19, 1976

[51] Int. Cl.[2] ..... A62C 39/10

[52] U.S. Cl. ..... 169/37; 239/209; 285/32; 285/302

[58] Field of Search ..... 169/37, 41; 239/209, 239/208; 285/302, 32

[56] References Cited

U.S. PATENT DOCUMENTS

| | | | |
|---|---|---|---|
| 1,301,244 | 4/1919 | Ford | 285/32 |
| 2,968,440 | 1/1961 | Cone | 285/302 X |
| 3,194,316 | 7/1965 | Faulkner et al. | 169/37 |
| 3,317,144 | 5/1967 | Muschett | 285/302 X |
| 3,529,671 | 9/1971 | Adams, Jr. | 285/302 X |

*Primary Examiner*—Robert W. Saifer
*Attorney, Agent, or Firm*—Fishburn, Gold & Litman

[57] ABSTRACT

An adjustable drop nipple for sprinkler heads is disclosed which comprises a stationarily mounted collar with internal threads that receives an externally threaded nipple, and whereupon rotating the nipple a portion of its length is caused to retract into the collar or extend from it, depending on the direction of rotation, in order to precisely regulate vertical elevation of a sprinkler head attached to the lower end of the nipple. An effective seal against leakage of water is achieved by use of one or more O-rings on the nipple which abut a smooth bore section inside the collar.

4 Claims, 4 Drawing Figures

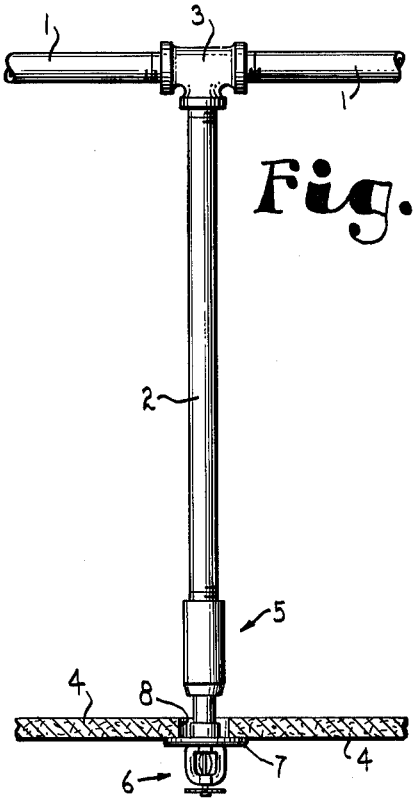
Fig. 1.
Fig. 2.
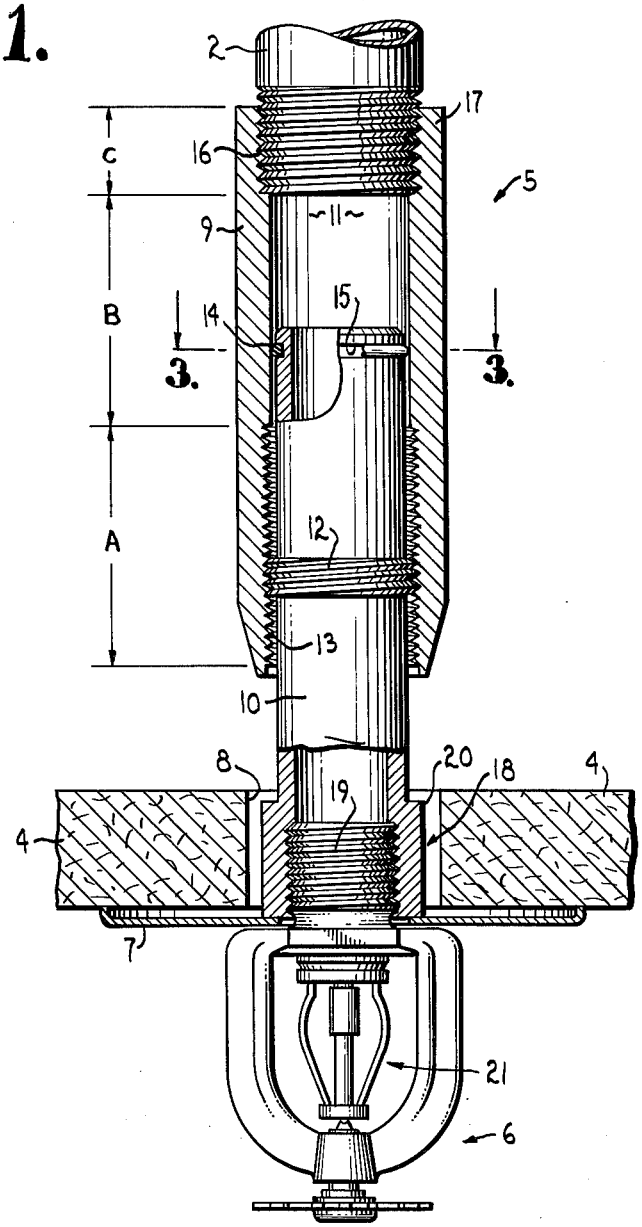
Fig. 4.
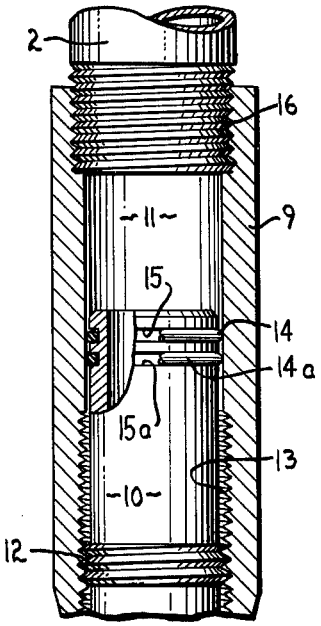
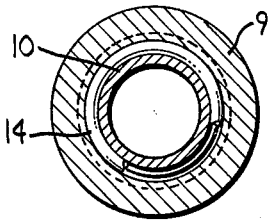
Fig. 3.

ADJUSTABLE DROP NIPPLE FOR SPRINKLER HEADS

BACKGROUND OF THE INVENTION

The present invention pertains to sprinkler systems which are installed in structures for protection against fire, and more particularly pertains to adjustable drop nipples which can be employed during the installation of sprinkler systems wherein the sprinkler heads hang below a ceiling. The present drop nipple can be used to particular advantage with "wet" sprinkler systems, but can also be employed, if preferred, with "dry" sprinkler systems.

When a number of ceiling sprinklers are installed above a room, the water distribution piping is mounted in the space between the ceiling and the next higher floor or roof, and it is extremely difficult, if not impossible, to install both the ceiling of the room and a non-adjustable piping arrangement to precise elevations which, without adjustment, will result in flush alignment of the sprinkler heads with the ceiling panels, since neither can be made perfectly level. More specifically, if all the drop nipples are made up to the same length, some will provide the effect of being too short, and others too long, so that alignment of the sprinkler heads with the ceiling can only be accomplished by customizing the length of the drop nipple at each location, or by use of a drop nipple having an adjustable length.

The making up of each drop nipple to a different length requires considerable time and is, therefore, relatively expensive. This problem has been previously recognized and has been approached by design and use of drop nipples which can be adjusted in length, examples being the adjustable drop nipples disclosed in U.S. Pat. Nos. 3,529,671 and 3,807,503. Each of the drop nipples disclosed therein comprises a first conduit which is inserted in a second conduit, the first conduit being movable axially back and forth in the second for adjusting the length of the assembly. In addition, the prior drop nipples make use of O-ring selas to protect against leakage of water when the sprinkler system is idle. It is nonetheless felt, however, that these prior adjustable drop nipples have certain drawbacks associated with their O-ring seal system and/or the complexity and cost of their manufacture.

SUMMARY OF THE INVENTION

It is therefore an object of this invention to provide an improved adjustable drop nipple which overcomes the previously mentioned drawbacks of prior adjustable drop nipples.

Another object is to provide an improved adjustable drop nipple which can be easily and economically manufactured, easily installed for accomplishment of its purpose, and which is reliable against leaking of a fire extinguishing liquid contained therein.

Still another object is to provide an adjustable drop nipple having an improved O-ring sealing system.

Other objects and advantages of the present invention will become apparent from the following description, the drawings, and the appended claims.

The present invention is a vertically adjustable drop nipple which comprises a collar and a nipple which are axially interconnected to provide a unit which is adjustable in length. Accordingly, the inner bore length of the collar comprises a threaded section having internal threads and a smooth bore section, whereas the nipple is rotatably interconnected with the threaded section of the collar by means of external threads on the nipple. The nipple has at least one O-ring groove thereon with an O-ring installed therein, and the O-ring abuts the smooth bore section of the collar.

BRIEF DESCRIPTION OF THE DRAWINGS

FIG. 1 illustrates the present drop nipple in use with one unit of an installed sprinkler system.

FIG. 2 is a side view, partly in section, of an adjustable drop nipple constructed in accordance with the present invention.

FIG. 3 is a cross-sectional view taken along line 3—3 of FIG. 2.

FIG. 4 is a side view, partly in section, of the drop nipple shown in FIG. 3, with the exception that an optional installation of two O-rings is illustrated.

DESCRIPTION OF PREFERRED AND ALTERNATIVE EMBODIMENTS

In FIG. 1, a water supply pipe 1 of a sprinkler system is rigidly attached to roof joists (not shown) of a structure being protected against fire. A vertically disposed nipple 2 installed in pipe tee 3 extends downward toward a ceiling tile 4 of the structure. The upper end of an adjustable drop nipple, generally represented at 5, is threadedly attached to the lower end of nipple 2, and a sprinkler head 6 is threadedly attached to the lower end of the drop nipple. An escutcheon plate 7 is installed between the sprinkler head 6 and the drop nipple 5 and serves as a cover for the opening 8 in the ceiling tile 4 through which the drop nipple extends.

Construction and operation of the present drop nipple can be determined from FIGS. 2–4 wherein a collar 9 is rotatably interconnected, axially, with a nipple 10. The term "rotatably interconnected" as used herein is intended to mean that the nipple 10 can be turned in the collar 9 by means of a low torquing force, e.g. turned by hand or easily turned with a wrench, as opposed to requirement of an exerted torquing force by means of a wrench. The inner bore of the collar 9 comprises a threaded section, having internal threads, which is represented at "A," and a smooth bore section which is represented at "B." The collar further comprises a threaded end, represented at "C," which is shown as having internal threads in the bore, but external threads can be used when preferred.

Rotatable interconnection of the nipple 10 with the collar 9 is accomplished by means of external threads 12 on the nipple which engage the internal threads 13 in the threaded section "A" of the collar. Since the threaded joint between the collar and nipple 10 is a relatively loose connection, a seal which prevents leakage of water past the walls of the collar and nipple is established by use of an O-ring 14 installed in a groove 15 therefor on the outside of nipple 10, and it should be noted that the O-ring abuts the smooth bore surface 11 in the smooth bore section "B" of the collar, and slides over the smooth bore surface when the nipple 10 is turned to change the overall length of the drop nipple 5. This feature represents a distinct improvement over O-rings sealing provisions of prior adjustable drop nipples in that the smooth bore surface can be made precisely round and very smooth, either by extrusion of the pipe or tubing section from which collar 9 is made, or by honing of the bore. In addition, this surface against which the O-ring bears and slides is, and remains, unexposed to nicks, scratches and other deformations which can occur as a result of handling and installing the drop nipple assembly.

It should be noted that in prior drop nipple assemblies the O-rings are mounted in the equivalent counterpart of collar 9 so that they bear against the outer surface of the equivalent counterpart of nipple 10. Since this counterpart of the nipple 10 will normally be made up of ordinary pipe, the outer surface thereof is not likely to be precisely round or smooth, absent the machining and polishing thereof, and the outer surface is also exposed to handling and installing activities which can easily result in defacing of the surface. It will thus be appreciated that unless the surface against which the O-ring bears and slides is established and maintained in a smooth and sufficiently round condition, the seal can be ineffective by failure of the O-ring to seat properly and/or because of damage to the O-ring.

As shown in FIGS. 2–4, the nipple 10 is provided with male threads 12, but it will be understood that these threads can be female threads provided that threads 13 of the collar are cut in a shoulder (not shown) inside the collar so that the outside wall of the nipple 10 will clear the inside wall of the collar 9 for extension and retraction of the nipple therein. In addition, the aforementioned threads of either the nipple or the collar should be substantially longer than the threads of the other so that the nipple can be run in and out of the collar for a preferred travel distance. In order to optimize a preferred travel distance and a preferred overall length of the drop nipple assembly, it is preferred that the threads of the collar which engage nipple 10 extend for a substantially greater length therein than the external threads of the nipple extend thereon, that the smooth bore section of the collar have a length which is at least about equal to the threaded section thereof, and that the O-ring be located on the nipple at a distance from the aforementioned collar-engaging external threads thereon which is at least about as great as the length of the aforementioned nipple-engaging threads on the collar.

Threads 12 and 13 on the nipple 10 and the collar 9, respectively can be coarse machine threads or acme threads. Tapered threads or fine threads are less preferable since they have a tendency to not run as freely during fitting, or fit up too tightly, or consume too much time in adjusting the drop length. The collar 9 can be provided with a second set of threads 16 at one end 17 thereof for threaded interconnection with the water supply nipple 2. This second set of threads 16 on the collar is preferably internal threads, and can be tapered pipe threads, and it is also preferred that they be located so that the smooth bore section "B" of the collar lies between the threaded section thereof and this second set of threads therein.

As shown in the drawings, the O-ring 14 can be located toward one end of the nipple 10 while providing the other end 18 thereof with threads 19 to receive a member such as a sprinkler head thereon by means of matching threads. Accordingly, it is preferred that the collar-engaging external threads 12 on nipple 10 be located between the O-ring and the member-receiving end 18. Threads 19 on the collar can, as a matter of choice, be internal as shown, or external.

Another preferred feature of the present invention is provision of a stopping means whereby insertion of the nipple 10 into the collar upon rotation of the nipple is halted before the threads 12 thereon reach the inner end of the threads in the threaded section of the collar. Accordingly, jamming or stripping of threads 12 and/or 13 upon inadvertant over tightening of the nipple 10 in the collar is thus prevented by use of the stopping means, a preferred form of which is an enlargement 20 at the outer end 18 of nipple 10 which has a diameter larger than the remainder of the nipple. As shown, the enlargement 20 is an integral part of the nipple, but a ring or flange, for example, which are attached to the nipple by threads or a locking screw can be alternatively employed. An enlargement such as 20 also provides the advantage of being a clamping and stabilizing means for the escutcheon plate 7 which is installed between the sprinkler head 6 and the nipple 10.

FIG. 4 represents an alternative embodiment of the invention wherein two O-rings 14 and **14*a*** are employed instead of only one, thus providing further assurance against leakage of water when such leakage is likely to cause considerably and costly damage to the structure and/or goods being protected. It will be appreciated, of course, that more than one or two O-rings can be employed when preferred.

Installation of a ceiling mounted sprinkler as shown in FIG. 1 can be accomplished in several ways, and one convenient manner is to first assemble the sprinkler head 6 and the escutcheon plate 7 on nipple 10, and/or nipple 2 on collar 9, followed by insertion of the assembly through hole 8 in ceiling tile 4 and connection of the nipple 2 in the pipe tee 3. Should it be observed that the assembly is too short for flush alignment of the escutcheon plate with the ceiling tile, it can be lengthened by turning nipple 10 so that it extends further outward from collar 9. Should it be observed that the assembly is too long, it can be shortened by turning nipple 10 so that it retracts further into the collar. The travel length of the nipple 10 in collar 9 should be long enough, e.g. within the range of about 1 to about 3 inches, for accomodation of such deviations in the elevation of the supply pipe 1 and ceiling tiles 4 as are normally encountered.

As was previously indicated, the present invention can be used to advantage with "wet" sprinkler systems wherein the drop nipple can be filled with water under pressure, and which is retained therein when the system is idle by the one or more O-rings and a thermally responsive element 21 of the sprinkler head 5. It will be understood, however, that the present drop nipple can also be used with "dry" sprinkler systems which contain compressed air when the system is idle.

An adjustable drop nipple which fulfills the previously stated objects has now been described in detail, and even though the invention has been described with reference to particular apparatus, combinations and arrangements of apparatus, conditions of use, and the like, it will nonetheless be understood that even other embodiments will become apparent which are within the spirit and scope of the invention defined in the following claims.

What is claimed and desired to secure by Letters Patent is:

1. A vertically adjustable drop nipple comprising:

(a) a collar wherein the inner bore length thereof comprises a threaded section having internal threads and a smooth bore section, (b) a nipple that is rotatably interconnected with said threaded section of the collar by means of external threads on the nipple, said nipple having at least one O-ring groove thereon with an O-ring installed therein, and wherein said O-ring abuts said smooth bore section of the collar, (c) said threads of the collar extending for a substantially greater length than said threads of the nipple, said smooth bore section of the collar having a length at least about equal to said threaded section thereof, said O-ring being located on said nipple at a distance from said threads thereon which is at least about as great as the length of said threaded section of the bore of the collar.

2. A vertically adjustable drop nipple comprising:

(a) a collar wherein the inner bore length thereof comprises a threaded lower section having internal threads and a smooth bore upper section, said collar threaded section having an open end, (b) a nipple that is rotatably interconnected with said threaded section of the collar by means of an externally threaded section on the nipple, said nipple having an outside wall of lesser diameter than said nipple threaded section and extending above said nipple threaded section, at least one O-ring installed therein, and wherein said O-ring is in sealing engagement with said smooth bore section of the collar, said nipple outside wall clearing said collar inner bore length whereby said nipple is insertable directly through said open end and vertically adjustable by rotating said nipple.

3. A drop nipple as set forth in claim 2 including:

(a) stopping means associated with said nipple and said collar whereby upon insertion of said nipple into said collar the rotation of said nipple therein is halted before said threaded section on said nipple reaches the end of said threaded section of the collar.

4. A drop nipple as set forth in claim 3 wherein:

(a) said stopping means comprises an enlargement on the nipple of larger diameter than the collar inserted portion of the nipple.

* * * * *